US007735646B2

(12) United States Patent
Scaletta et al.

(10) Patent No.: US 7,735,646 B2
(45) Date of Patent: Jun. 15, 2010

(54) TOOLBOX WITH WHEEL CHOCKS AS SUPPORTS

(76) Inventors: Samuel L. Scaletta, 4721 County Road M, Middleton, WI (US) 53562; Samuel J. Scaletta, 4721 County Road M, Middleton, WI (US) 53562

( * ) Notice: Subject to any disclaimer, the term of this patent is extended or adjusted under 35 U.S.C. 154(b) by 0 days.

(21) Appl. No.: 12/512,898

(22) Filed: Jul. 30, 2009

(65) Prior Publication Data

US 2009/0301913 A1 Dec. 10, 2009

Related U.S. Application Data

(62) Division of application No. 11/478,060, filed on Jun. 29, 2006, now abandoned.

(51) Int. Cl.
*B65D 85/20* (2006.01)
*E04G 1/28* (2006.01)
*A45C 5/00* (2006.01)

(52) U.S. Cl. ..... 206/373; 182/129; 190/18 R

(58) Field of Classification Search ..... 206/349, 206/372–373; 312/902; 190/18 R; 182/129; 211/41.1, 41.14
See application file for complete search history.

(56) References Cited

U.S. PATENT DOCUMENTS

| | | | | |
|---|---|---|---|---|
| 75,689 | A | 3/1868 | Mattson | |
| 3,980,203 | A | 9/1976 | Dearling | |
| 4,366,998 | A | 1/1983 | Kaiser | |
| 4,662,515 | A * | 5/1987 | Newby, Sr. | 312/902 |
| 4,717,020 | A | 1/1988 | Viira | |
| 4,720,021 | A * | 1/1988 | Byrns | 206/373 |
| 5,011,013 | A * | 4/1991 | Meisner et al. | 206/373 |
| 5,282,519 | A * | 2/1994 | Venturo et al. | 182/129 |
| 5,505,302 | A | 4/1996 | Ferley | |
| 5,638,913 | A | 6/1997 | Blum | |
| 5,727,857 | A | 3/1998 | Smith | |
| 5,848,701 | A | 12/1998 | Riccabona | |
| 5,882,097 | A | 3/1999 | Kohagen et al. | |
| 5,915,570 | A * | 6/1999 | Orsini | 211/41.1 |
| 5,971,102 | A | 10/1999 | Brown | |
| 6,098,748 | A | 8/2000 | Harper, Jr. et al. | |
| 6,109,446 | A | 8/2000 | Foote | |
| 6,439,630 | B1 | 8/2002 | Eatmon | |
| 6,761,366 | B1 | 7/2004 | Klemmensen et al. | |
| 6,935,641 | B2 | 8/2005 | Hahn | |
| 6,981,780 | B2 * | 1/2006 | Einav | 362/154 |
| 7,331,454 | B2 | 2/2008 | Godshaw et al. | |

* cited by examiner

*Primary Examiner*—Bryon P Gehman
(74) *Attorney, Agent, or Firm*—Foley & Lardner LLP

(57) ABSTRACT

The tool box comprises a lower bin having a pair of opposed sidewalls, a front wall, a rear wall, and a bottom wall that define a storage space, the bottom wall comprising a first recess and a second recess; and a lid coupled to the lower bin by a hinge and movable between a closed position and an open position. The lower bin and the lid support the weight of a person standing on the lid when the lid is in the first position. The lower bin and lid are positionable at a first height when the bottom wall is in contact with a floor and is positionable at a second height when the first recess receives the first chock and the second recess receives the second chock. The toolbox may also comprise an insert configured to divide the internal cavity between a lower space and an upper space and comprising an aperture. An object stored in the lower space may extend through the aperture in the insert into the upper space.

12 Claims, 15 Drawing Sheets

TOOLBOX WITH WHEEL CHOCKS AS SUPPORTS

CROSS-REFERENCE TO RELATED APPLICATION

The present application is a divisional of U.S. patent application Ser. No. 11/478,060 titled "Multi-Use Toolbox" filed Jun. 29, 2006, now abandoned the full disclosure of which is hereby incorporated herein by reference.

BACKGROUND

The present invention relates to a multi-use toolbox. More specifically, the present invention relates to a tool box with sufficient strength to support the weight of a person, to secure items inside, and provide a variety of features that are desirable where storage capacity, space limitation, and/or weight are limited for items such as toolboxes on an aircraft.

Tool boxes are generally known. Such known tool boxes typically include a bin (i.e., container, base, etc.), a lid or cover pivotally coupled to the base, and one or more trays that separate a storage area between a lower storage space and an upper storage space. The tray may be divided by walls into separate compartments. Items such as tools and other equipment and supplies are generally stored loosely in the lower space, on top of the tray, or sometimes in drawers.

However, such known toolboxes have several disadvantages including: lack of features to minimize required accessories or attachments to accommodate multiple uses and applications. For example, toolboxes carried on aircraft need to be compact and multifunctional to minimize the space and weight for equipment needed to do routine and non-routine tasks.

Accordingly, it would be advantageous to provide a multi-use toolbox. It would also be advantageous to provide a toolbox designed for use with aircraft and other applications where it is advantageous to hold or secure containers inside the toolbox, use the toolbox as a ladder, elevate the toolbox for the user to reach greater heights, and the like. It would be desirable to provide for a multiple use tool box having one or more of these or other advantageous features. To provide an inexpensive, reliable, and widely adaptable tool box that avoids the above-referenced and other problems would represent a significant advance in the art.

SUMMARY

The present invention relates to a tool box for storage and for use with a first wheel chock and a second wheel chock. The tool box comprises a lower bin having a pair of opposed sidewalls, a front wall, a rear wall, and a bottom wall that define a storage space, the bottom wall comprising a first recess and a second recess; and a lid coupled to the lower bin by a hinge and movable between a closed position and an open position. The lower bin and the lid support the weight of a person standing on the lid when the lid is in the first position. The lower bin and lid are positionable at a first height when the bottom wall is in contact with a floor and is positionable at a second height when the first recess receives the first chock and the second recess receives the second chock.

The present invention also relates to a tool box comprising a lower bin having a pair of opposed sidewalls, a front wall, a rear wall, and a bottom wall that define a storage space; a lid coupled to the lower bin by a hinge and movable between a first position and a second position; and an insert supported by, and at least partially located in, the lower bin, the insert configured to divide the internal cavity between a lower space and an upper space and comprising an aperture. An object stored in the lower space may extend through the aperture in the insert into the upper space.

The present invention further relates to a method of using a toolbox having a bin and a lid pivotally coupled to the bin, the bin having a pair of opposed sidewalls, a front wall, a rear wall, and a bottom wall that define a storage space. The method comprises providing a first object and a second object that are not generally associated with the toolbox. The method also comprises arranging the first and second objects on the ground. The method further comprises mounting the toolbox on the objects by receiving a portion of the objects in recesses in the bottom wall of the bin thereby providing lateral support and stepping on the lid of the tool box.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF THE PREFERRED AND EXEMPLARY EMBODIMENTS

Before proceeding to the detailed description of the preferred and exemplary embodiments, several comments can be made about the general applicability and the scope thereof.

First, while the components of the disclosed embodiments will be illustrated as a toolbox designed for aircraft applications, the features of the disclosed embodiments have a much wider applicability. For example, the toolbox design is adaptable for other storage units, bins, containers, and other office, home, or educational products which employ a storage device configured for multiple uses and functions. Further, the size of the various components and the size of the containers can be widely varied.

Second, the particular materials used to construct the exemplary embodiments are also illustrative. For example, injection molded high density polyethylene is the preferred method and material for making the top and base, but other materials can be used, including other thermoplastic resins such as polypropylene, other polyethylenes, acrylonitrile butadiene styrene ("ABS"), polyurethane, nylon, any of a variety of homopolymer plastics, copolymer plastics, plastics with special additives, filled plastics, etc. Also, other molding operations may be used to form these components, such as blow molding, rotational molding, etc. Components of the toolbox can also be manufactured from stamped alloy materials such as steel or aluminum.

Third, it is important to note that the term "toolbox," "insert," and "chock" are intended to be broad terms and not terms of limitation. These components may be used with any of a variety of products or arrangements and are not intended to be limited to use with aircraft applications.

Figure 1:
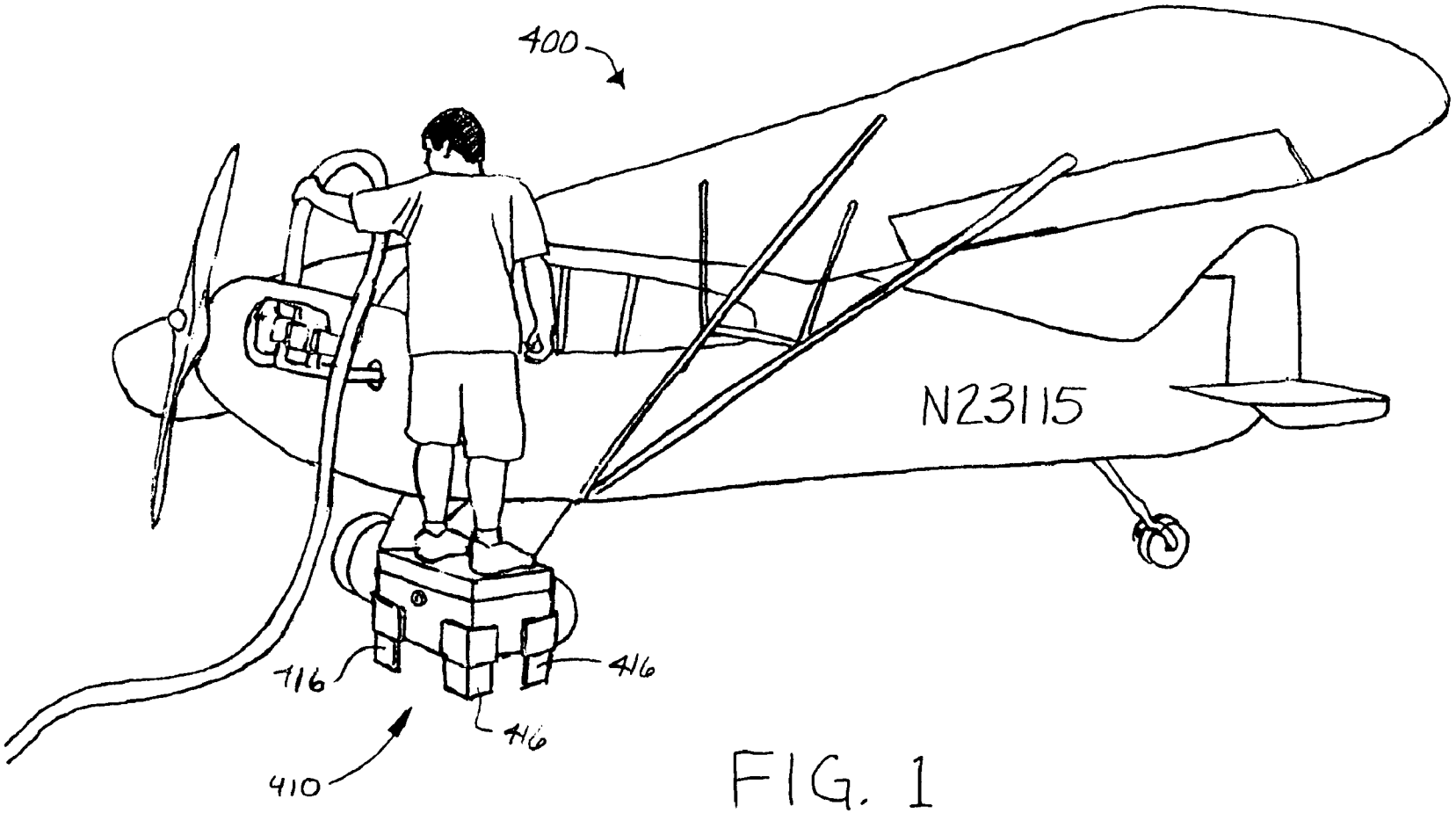
FIG. 1 is a perspective view of a toolbox supported on a plurality of wheel chocks to provide an elevated surface for a user to inspect, refuel, and/or maintain an aircraft.

FIG. 1 is a perspective view of a multi-use toolbox 410 supported on a plurality of wheel chocks 416 to provide an elevated surface for a user to refuel, maintain, and/or inspect an aircraft 400. Toolbox 410 is configured to provide sufficient structural strength and rigidity to support the weight of a person, to secure items inside, and provide a variety of features that are desirable where storage capacity, space limitation, and/or weight are limited for items such as toolboxes such as on aircraft.

Figure 2:
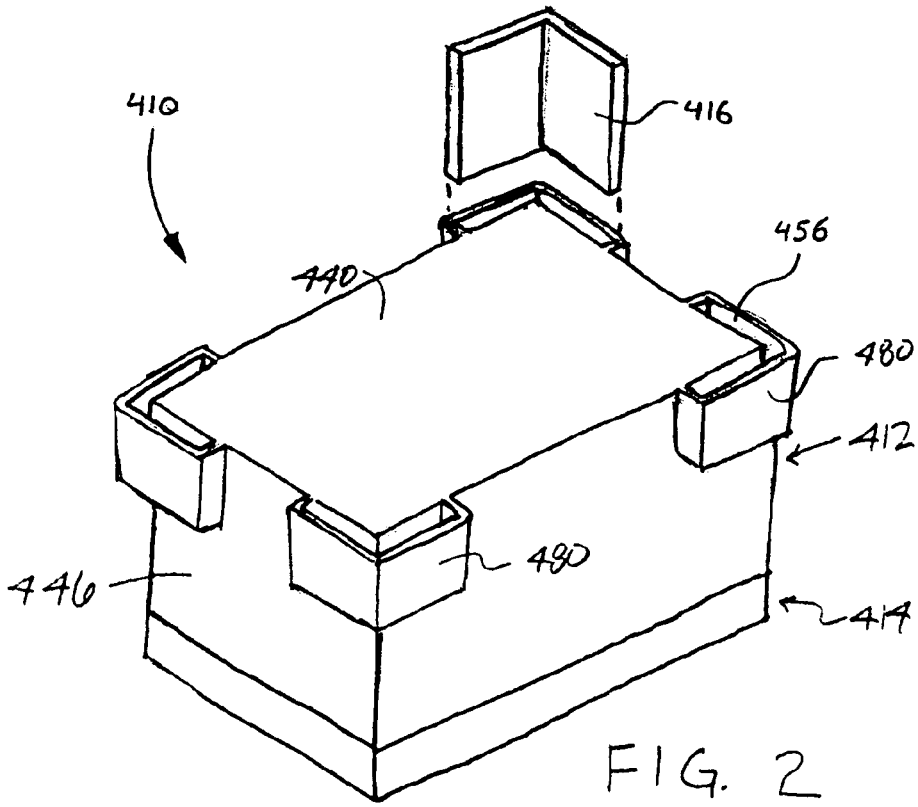
Figure 4:
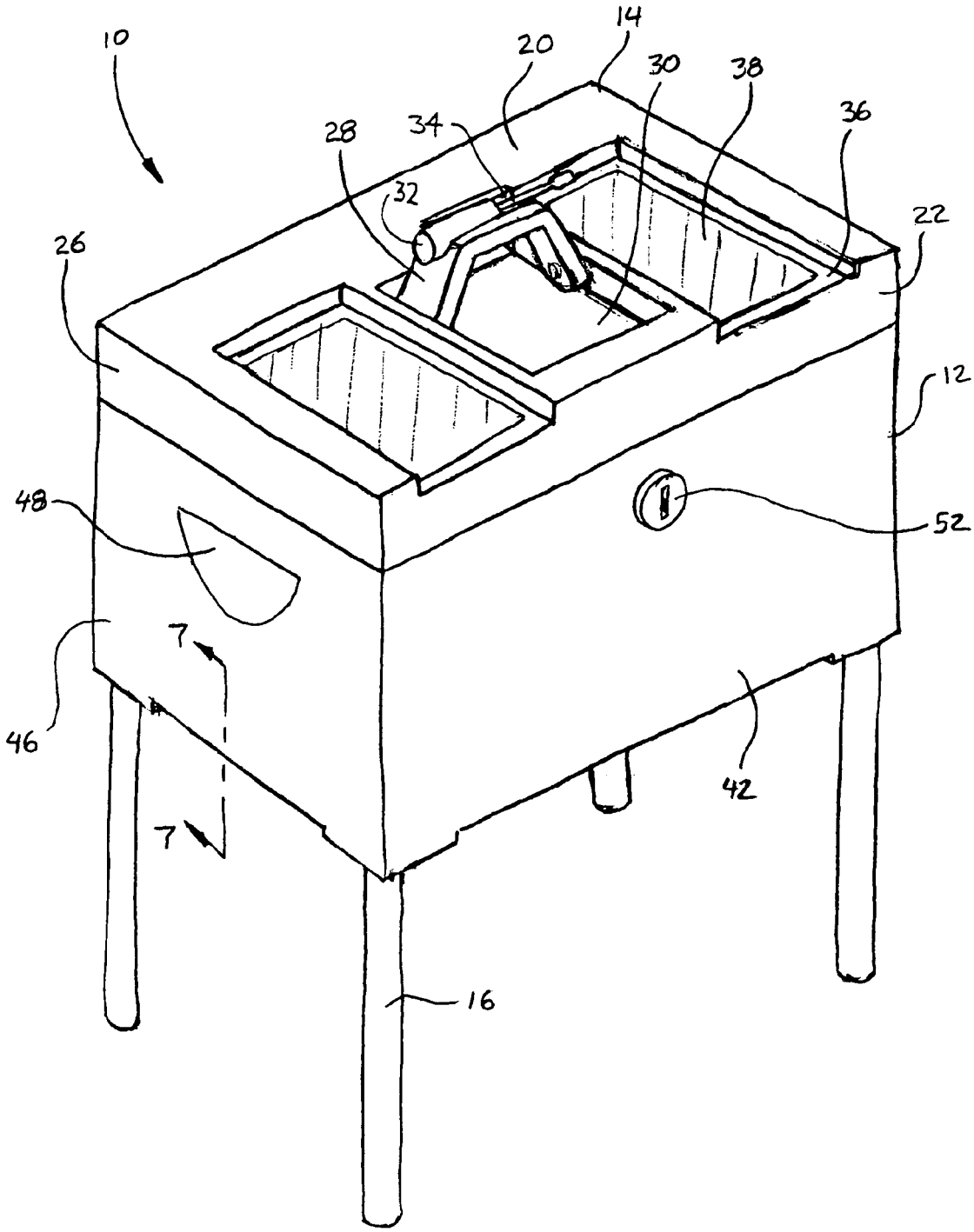
FIG. 4 is an schematic isometric view of a toolbox in a closed configuration according to an exemplary embodiment.

FIG. 2 is an exploded schematic perspective view of toolbox 410 according to an exemplary embodiment of coupling wheel chocks 416 to toolbox 410. Toolbox 410 includes a base 412 and a lid 414. Base 412 includes a bottom wall 440 and sidewalls 446. Bottom wall 440 includes recesses 456 (slots, receptacles, notches, openings, apertures, etc.) configured to receive wheel chocks 416. Toolbox 410 is similar to toolbox 310 except that recesses 456 are located outside of sidewalls 446 and preferably are structurally supported by a molded wall 480 defining recesses 456 on the outside of base 412. Locating recesses 456 on the outside of base 412 provides more storage space on the inside base 412. To provide an elevated surface, chocks 416 are inserted into recesses 456 and toolbox 410 is turned over and supported by chocks 416 extending from bottom wall 440 of toolbox 410.

Figure 3:
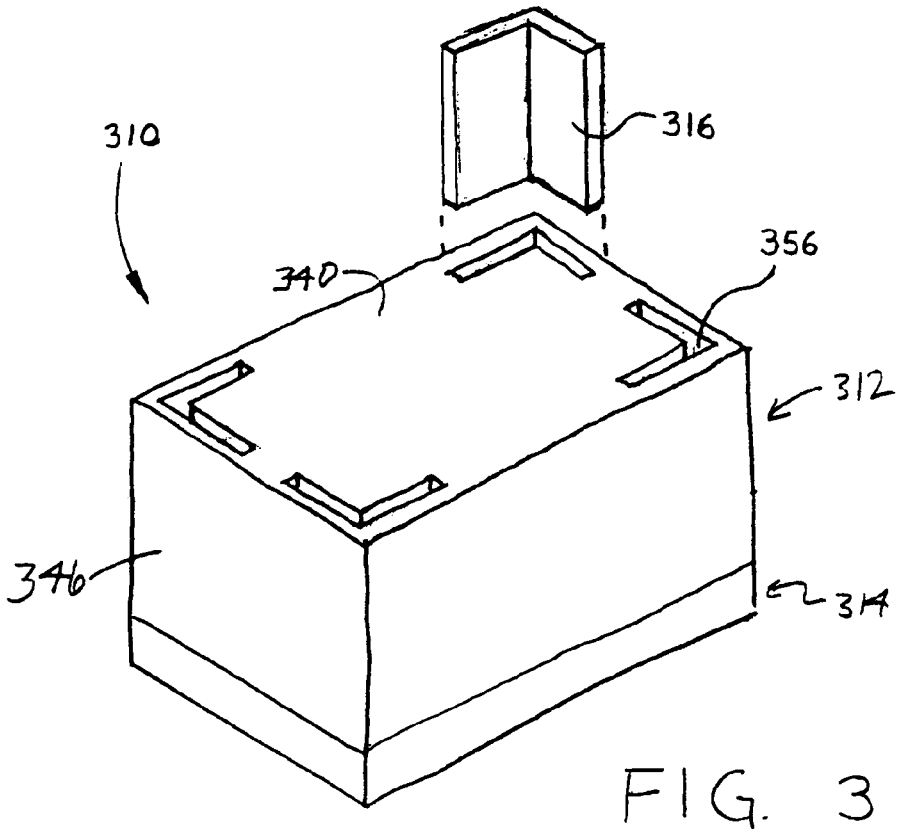
FIGS. 2-3 are schematic isometric views of toolboxes according to exemplary embodiments showing means of coupling wheel chocks to the toolboxes.

FIG. 3 is an exploded schematic perspective view of a toolbox 310 according to an exemplary embodiment of coupling wheel chocks 316 to toolbox 310. Toolbox 310 includes a base 312 and a lid 314. Base 312 includes a bottom wall 340 and sidewalls 346. Bottom wall 340 includes recesses 356 (slots, receptacles, notches, openings, apertures, etc.) configured to receive wheel chocks 316. Toolbox 310 is similar to toolbox 410 except that recesses 356 are located inside of sidewalls 346 and preferably are structurally supported by a molded wall defining slot on the inside of base 312. Recesses 356 are shown as slot in bottom wall 340 and having a first portion and a second portion that extends from the first portion at an angle. The angle of the slot portions is shown as an approximately 90 degree angle, but may be any of a variety of angles depending on the shape, size, and configuration of the wheel chock or other item being used as a support for the toolbox. To provide an elevated surface, chocks 316 are inserted into recesses 356 and toolbox 310 is turned over and supported by chocks 316 extending from bottom wall 340 of toolbox 310.

Referring to FIGS. 2-5 a toolbox 10 is shown according to an exemplary embodiment. Toolbox 10 is configured to provide sufficient strength to support the weight of a person, to secure items inside, and provide a variety of features that are desirable where storage capacity, space limitation, and/or weight are limited for items such as toolboxes such as on aircraft. Toolbox 10 is further configured as a step for a user. Toolbox 10 is a generally thin-walled box and comprises a lid 14 (e.g., upper bin, top portion, cover, etc.), a base 12 (e.g., lower bin, bottom portion, box, etc.) and legs 16 (e.g., tie-down members, wheel chocks, support members, props, struts, etc.) that are configured to elevate toolbox 10. Toolbox 10 is configured to hold tools, supplies, flashlight, funnel, liquid supply container (e.g., oil, etc.) and/or other objects or a combination of these.

Lid 14 comprises a top 20 with a hollow 30 and step areas 36, a front side wall 22 and rear side wall 24 that are generally parallel, two opposing end side walls 26 that are perpendicular to front side wall 22 and rear side wall 24, and a handle 28. According to an exemplary embodiment, side walls 22, 24, 26 extend downward from top 20 and are formed as a single unitary body with top 20. According to other exemplary embodiments, side walls 22, 24, 26 may be separate bodies and coupled to top 20 and each other with brackets or other suitable coupling members.

Handle 28 is configured to allow a user to pick up or otherwise move toolbox 10. According to one exemplary embodiment, handle 28 is pivotably coupled to lid 14 and is moveable between a deployed or vertical position in which it is configured to be grasped by a user and a stowed or horizontal position in which it is configured to allow a user to stand on toolbox 10. In the stowed position, handle 28 is at least partially received by hollow 30 (e.g., depression, cavity, indentation, etc.) provided in top 20. Handle 28 may be further configured to receive a tool 32, shown as a screwdriver. According to an exemplary embodiment, handle 28 comprises a contour 34. Contour 34 may be any of a variety of structures configured to securely retain tool 32 (e.g., recess, receptacle, snap-fit, interference fit, etc.) on one the top surface that is configured to substantially secure tool 32 with a snap-fit. According to other exemplary embodiments, tool 32 may be coupled to handle 28 other ways (e.g., with protruding clips, flexible members, etc.) or may be received by a different portion of handle 28 (e.g., along a side surface, along the bottom surface etc.).

Lid 14 may further comprise step areas 36. Step areas 36 are defined areas that are configured to receive the foot of a user stepping on toolbox 10 and may include non-skid surfaces 38 (e.g., wing walk tape or other material). Step areas 36 are sized, orientated, contoured, and/or otherwise provided to encourage a user to step towards the sides of toolbox 10 so that at least a portion of the weight of the user is generally supported by side walls 22, 24, 26 and to prevent damage to handle 28 or weight being directly applied to other portions of toolbox 10. According to one exemplary embodiment, step areas 36 are depressions in top 20 generally disposed towards end side walls. According to other exemplary embodiments, step areas 36 may be defined by a short protrusion (e.g., wall, ridge, partition etc.), shallow score, surface marking (e.g., ink, paint, surface texture, etc.) or other suitable method. According to still other exemplary embodiments, step areas 36 may not be defined and non-skid surfaces 38 may be provided on top 20.

Base 12 comprises a bottom 40, a front side wall 42 and rear side wall 44 that are generally parallel, two opposing end side walls 46 that are perpendicular to front side wall 42 and rear side wall 44. According to an exemplary embodiment, side walls 42, 44, 46 extend upward from bottom 40 and are formed as a single unitary body with bottom 40. According to other exemplary embodiments, side walls 42, 44, 46 may be separate bodies and coupled to bottom 40 and each other with brackets or other suitable coupling members. End side walls 46 may comprise integrally formed side handles 48.

Figure 5:
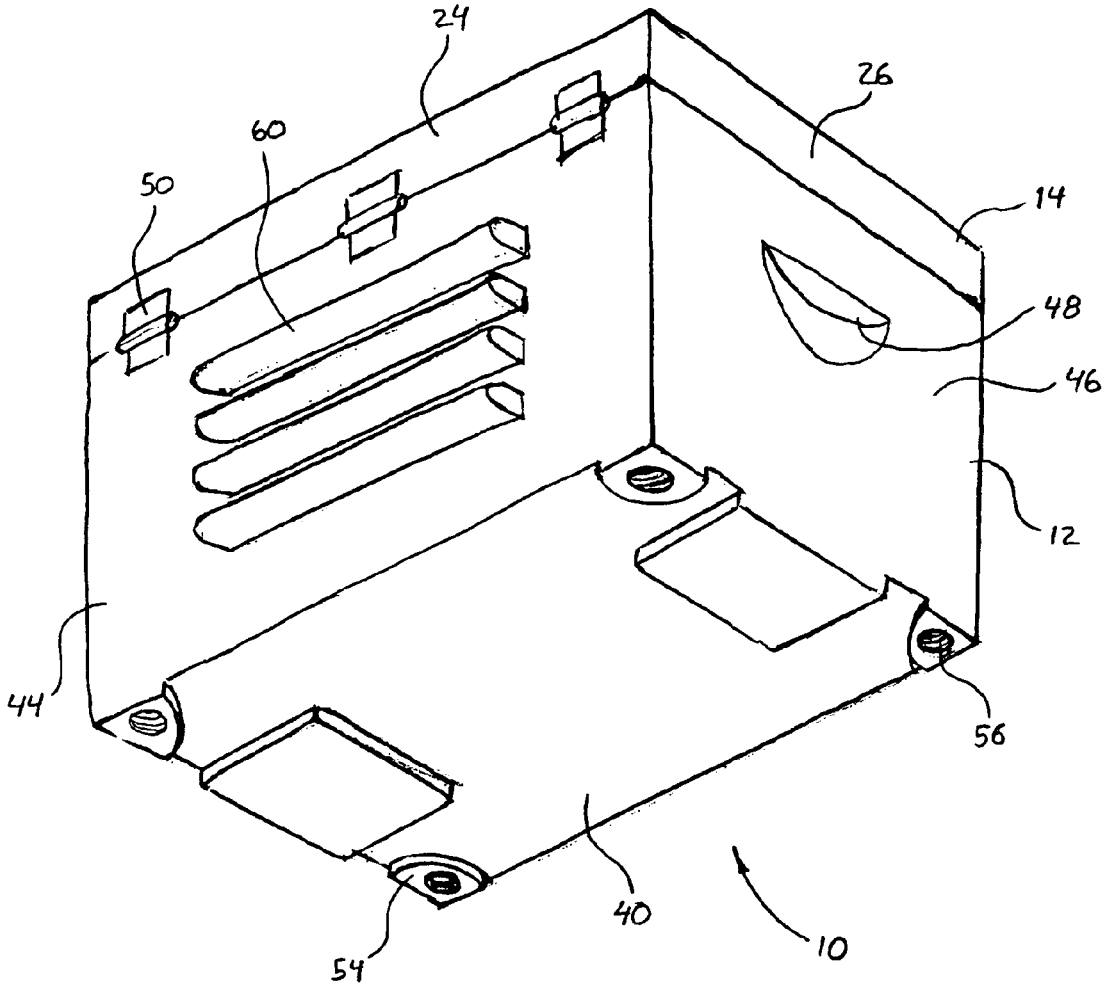
FIG. 5 is a schematic isometric view showing the bottom of the toolbox in FIG. 4.

Base 12 may be pivotably coupled to lid 14 along one side with one or more hinges 50 and may be moveable between an open position and a closed position. As shown in FIG. 5 and according to one exemplary embodiment, hinges 50 are coupled to rear side walls 24, 44. According to other exemplary embodiments, the hinge may optionally be a single piano-style hinge, or may be another hinge-like mechanism known to those of skill in the art. Toolbox 10 comprises a locking mechanism 52 that is configured to substantially retain lid 14 in a closed position. According to other exemplary embodiments, toolbox 10 may include a latch or other latching or locking mechanisms known to those of skill in the art that prevent the lid 14 from freely pivoting from the base 12 on hinge 50.

Figure 6:
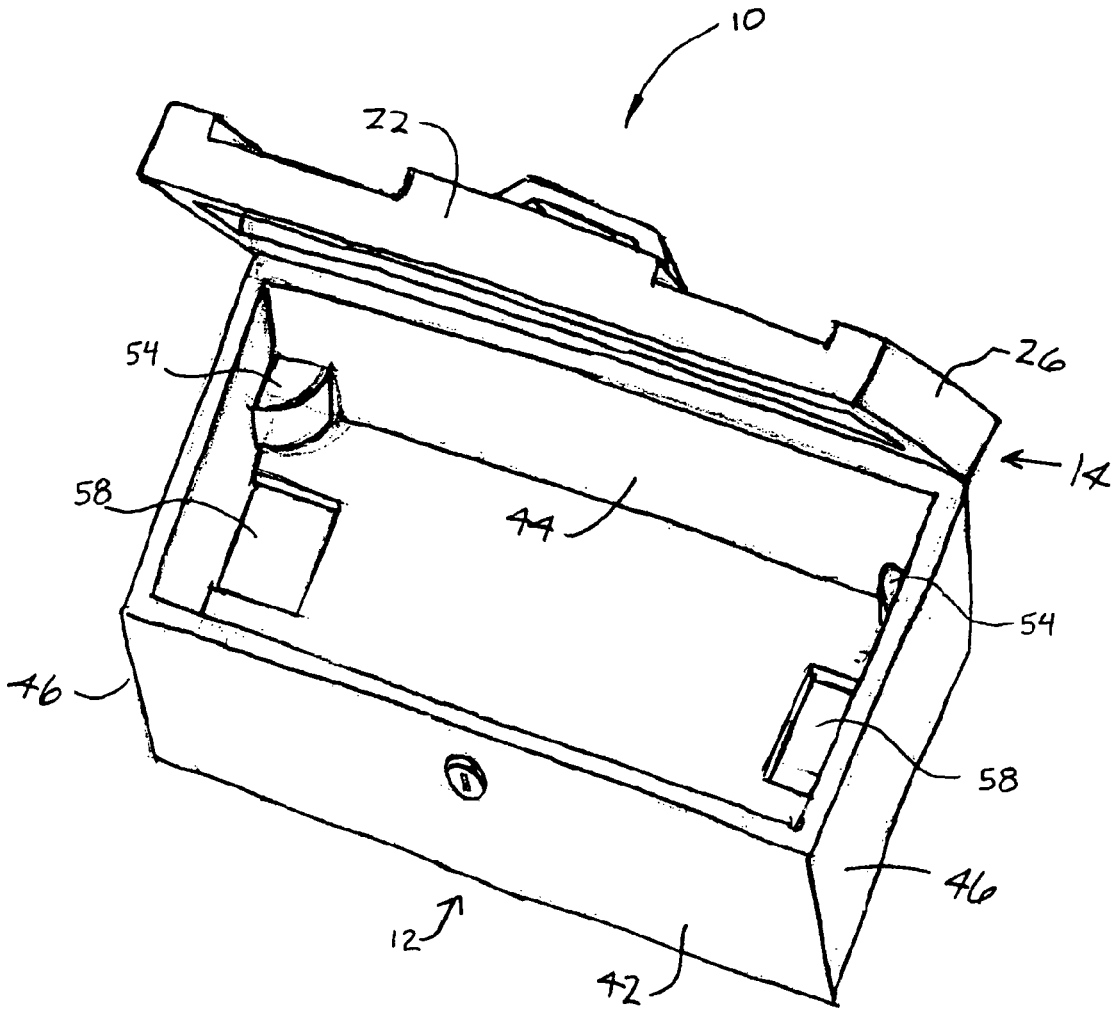
FIG. 6 is a schematic isometric view of the toolbox in FIG. 4 in an open configuration showing the interior of the toolbox.

Referring now to FIGS. 5-6 and according to one exemplary embodiment, base 12 comprises reinforced areas 54, sockets 56, and retention areas 58. Reinforced areas 54 (e.g., support areas, strengthened areas, etc.) are provided in bottom corners of toolbox 10 extending upward from bottom 40 and are configured to add strength and rigidity to bottom corners of toolbox 10. Reinforced areas 54 surround sockets 56 (e.g., holes, openings, apertures, etc.) that are configured to receive legs 16.

Legs 16 are provided to raise the elevation of toolbox 10 such that a person may gain elevation by standing upon toolbox 10 when raised on legs 16 (e.g., to inspect, repair, conduct maintenance, refuel, etc.). According to an exemplary embodiment legs 16 are configured to raise toolbox approximately between one and two feet. According to one exemplary embodiment, sockets 56 are threaded holes that are configured to allow legs 16 to be threadably coupled to base 12. According to other exemplary embodiments, legs 16 may be received by sockets 16 in another manner (e.g., a bayonet-style connection, a snap-fit connection, etc.) that suitably couples legs 16 to base 12.

Figure 7A:
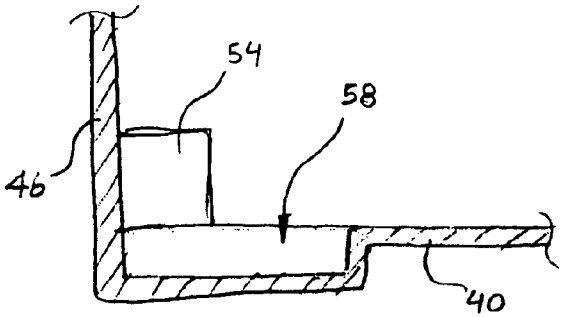
FIGS. 7A- and 7B are partial cross-sections of the toolbox in FIG. 4 taken along line 7-7 showing a retention area according to two exemplary embodiments.
Figure 7B:
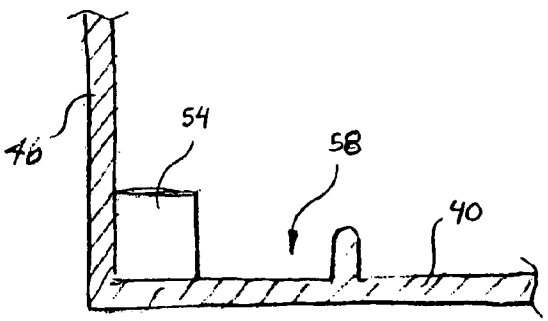

Referring to FIGS. 6, 7A, and 7B, retention areas 58 are areas that are configured to receive commonly used items (e.g., containers, bottles, supplies, tools, flashlights, tie-downs, etc.) and substantially prevent their free movement around the interior of toolbox 10. According to one exemplary embodiment, retention area 58 is a recessed area in bottom 40 configured to receive a bottle or container of oil or other liquid supply for use with an aircraft where it is preferred that it does not tip over during flight, being moved to storage/for use, or the like. According to other exemplary embodiment, retention area may comprise a protrusion (e.g., wall, ridge, partition etc.) extending upward from bottom 40 or may be configured to receive another tool or object.

Figure 14:
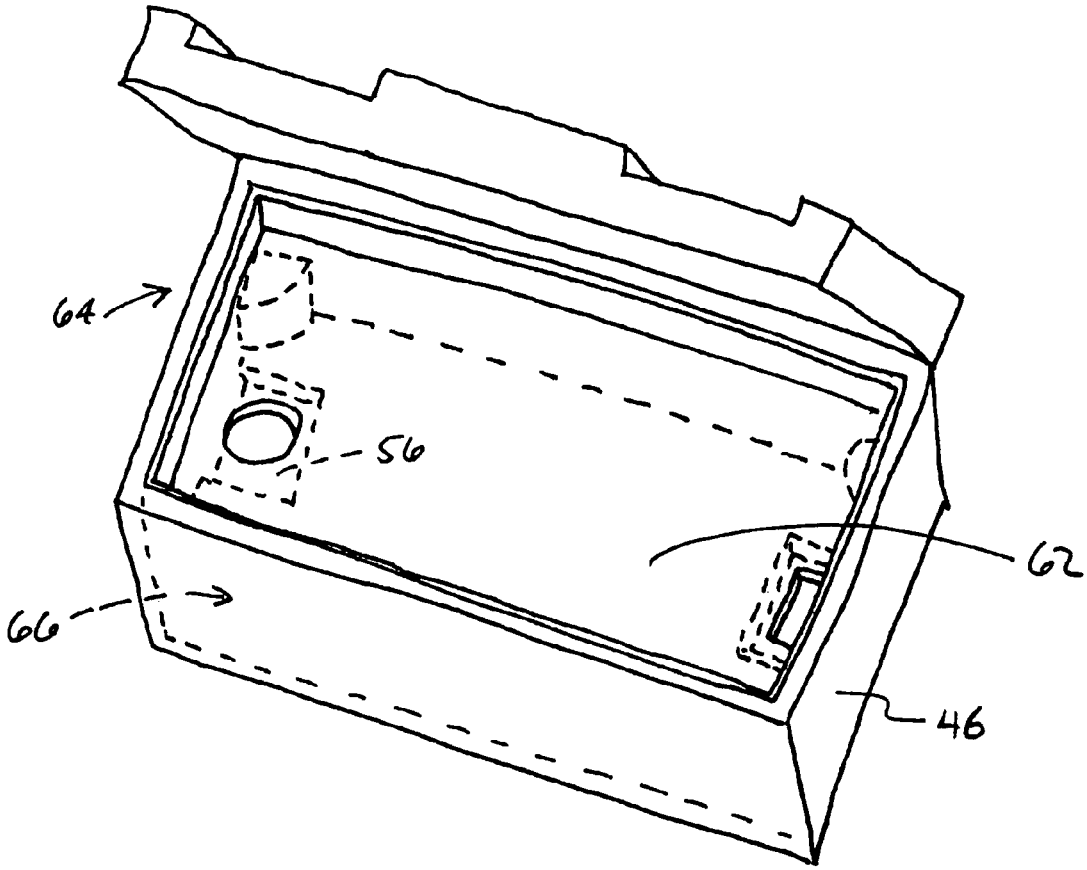
FIG. 14 is a perspective view of an insert with apertures for engaging an item stored in the toolbox.
Figure 15A:
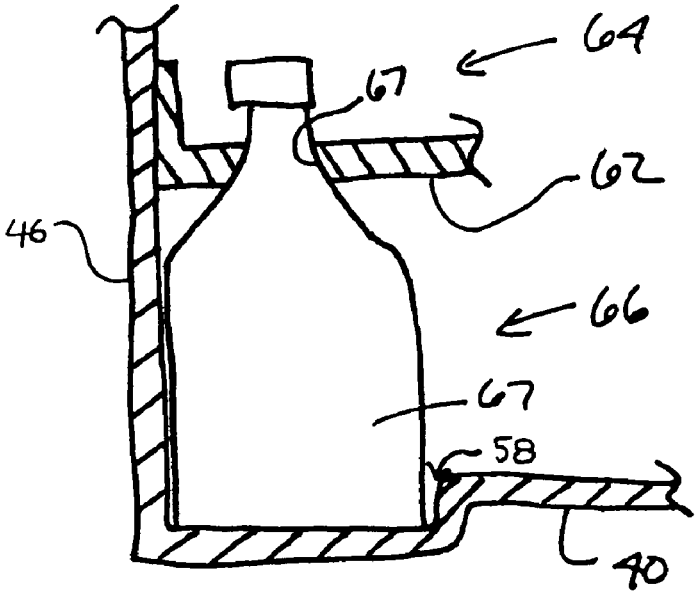
FIGS. 15A and 15B are partial cross-sections of the toolbox in FIGS. 7A- and 7B showing an item stored in retention area and secured in an aperture in an insert according to two exemplary embodiments.
Figure 15B:
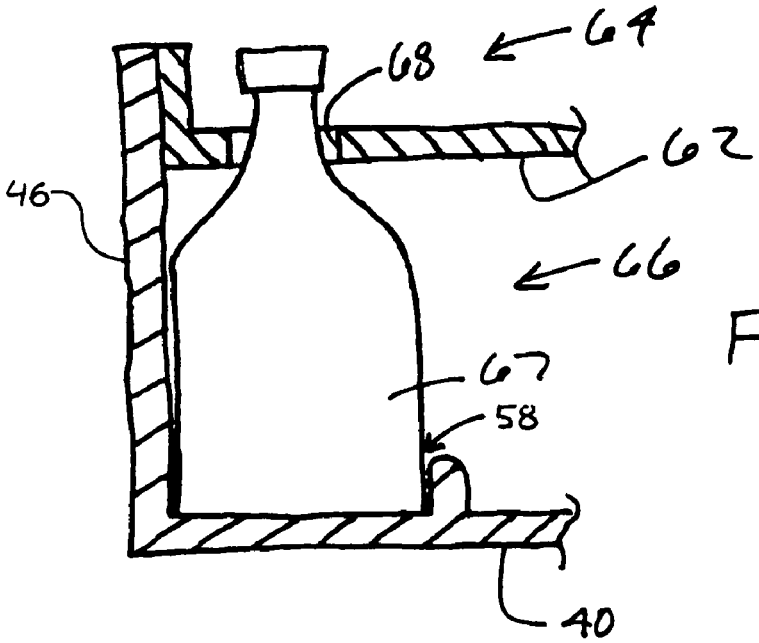

According to an exemplary embodiment, toolbox 10 further comprises an insert 62 (shown in FIGS. 14, 15A and 15B). Insert 62 may be a tray, panel, or any of a variety of structures that supported by, and at least partially located in, base 12. Insert 62 may be configured to divide or split the internal cavity between a lower space 66 and an upper space 64. Insert 62 may also be used to receive and support a variety of items such as tools and other supplies as conventional trays do, and may have one or more walls or dividers to provide separate compartments. Insert 62 further comprises a retaining feature (e.g., aperture, hole, indentation, notch, opening, etc., and generally shown as an aperture 68). Aperture 68 is configured to receive and secure an item and prevent undesired movement of the item, such as tipping, sliding, or the like. The item 67 may be any of a variety of tools or supplies that may split or be damaged if the undesired movement occurs, such as containers of a material (e.g., liquid, oil, lubricant, fuel, gas/vapor, a solid, powder, etc.), fragile items (e.g., light bulbs, electronics, etc.), or the like. According to an exemplary embodiment, aperture 68 is aligned or registered with retention areas 58 formed in base 12 to provide further securement of the item.

Figure 13A:
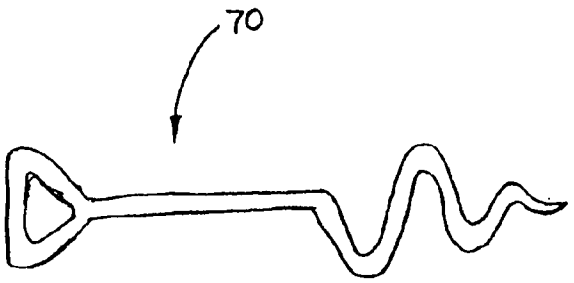
FIGS. 13A and 13B are schematic views of tie-downs according to exemplary embodiments.
Figure 13B:
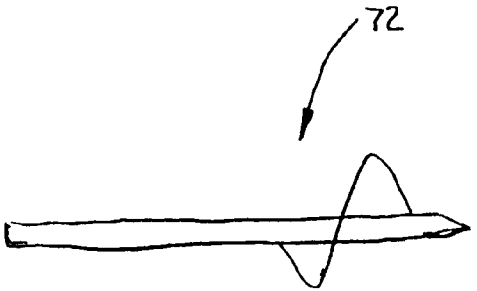

Referring again to FIG. 5, engaging structures 60 are shown according to an exemplary embodiment. Engaging structures 60 (e.g., ridges, retainers, holders, etc.) are features that are configured to receive (grip, retain, secure, etc.) complimentary articles such as legs 16 and/or tie-downs 70, 72 such as those shown in FIGS. 13A-13B. These two illustrated styles are not intended to be limiting of the present disclosure, but rather exemplary of the type of items that can be used. Engaging structures 60 may be spaced such that legs 16 or the shaft portions of tie-downs 70, 72 may be inserted in between engaging structures 60 and held in a friction fit. According to one exemplary embodiment, toolbox 10 comprises four engaging structures 60 that are generally linear, continuous structures or projections. According to other exemplary embodiments, more or fewer engaging structures 60 may be provided. According to other exemplary embodiments, engaging structures 60 may comprise multiple discrete portions.

Figure 17:
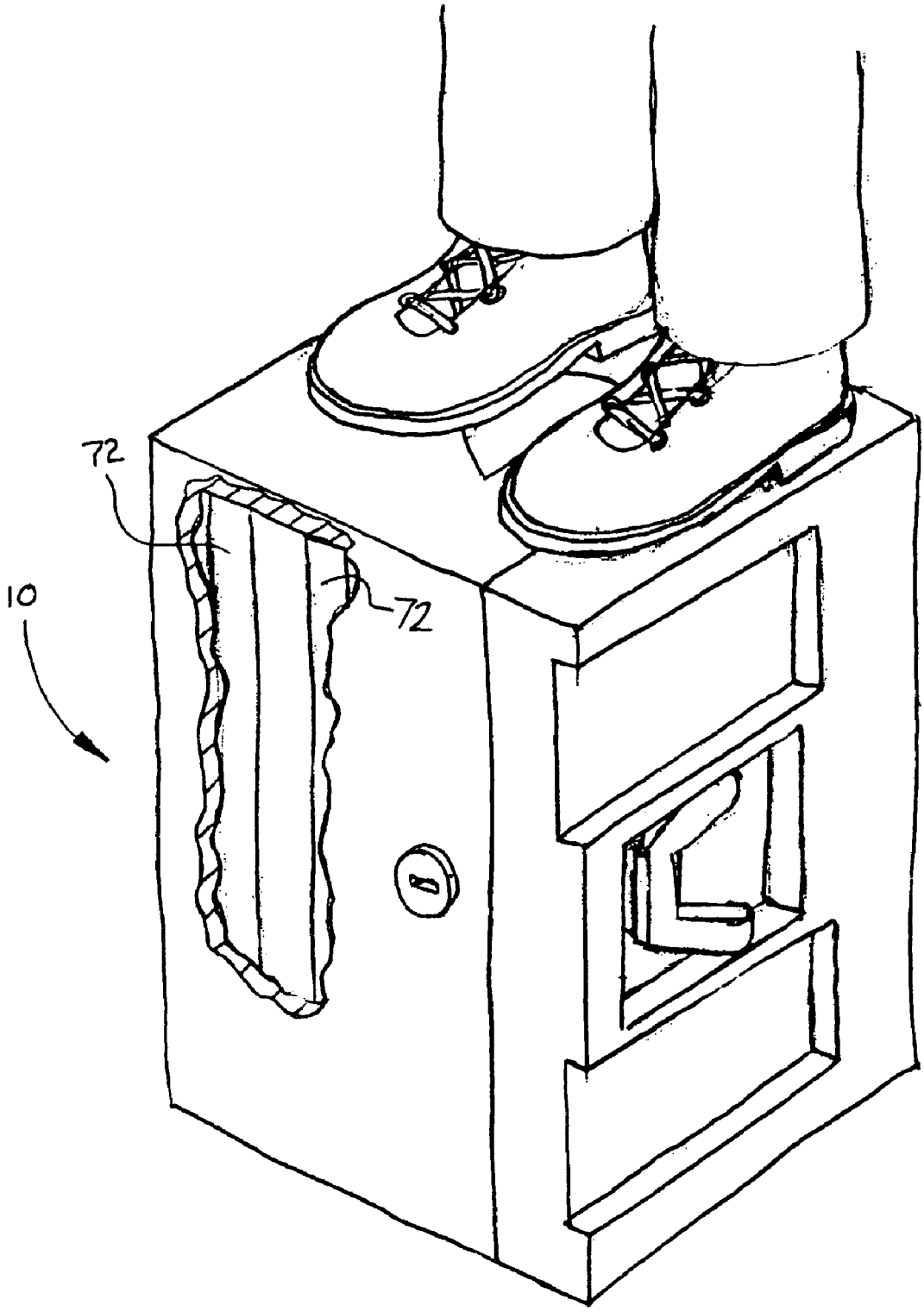
FIG. 17 is an isometric view of the toolbox in FIG. 5 on its side being used by a user as a step.

In some embodiments, toolbox 10 may be reinforced in sidewalls 22, 24, 26, 42, 44 and 46 to support the weight of a person standing thereon or for further support for insert 62. This support may be provided by providing ribbing in the top, bottom, and/or sidewalls, by thicker sidewalls, or by other supporting features (e.g., reinforced areas 54, etc.). According to an alternative embodiment shown in FIG. 17, toolbox 10 is sufficiently reinforced so that it may be positioned on its side and stood on by a user to provide elevation. For example, the toolbox may be sized or dimensioned so that storage and orientation of tie-downs (tie-down 72 is shown in the figure) retained in place by engaging structures 60 provide structural reinforcement to the base and/or lid. Alternatively, metal or rigid polymer reinforcement members may be added to the base and/or lid.

Figure 8:
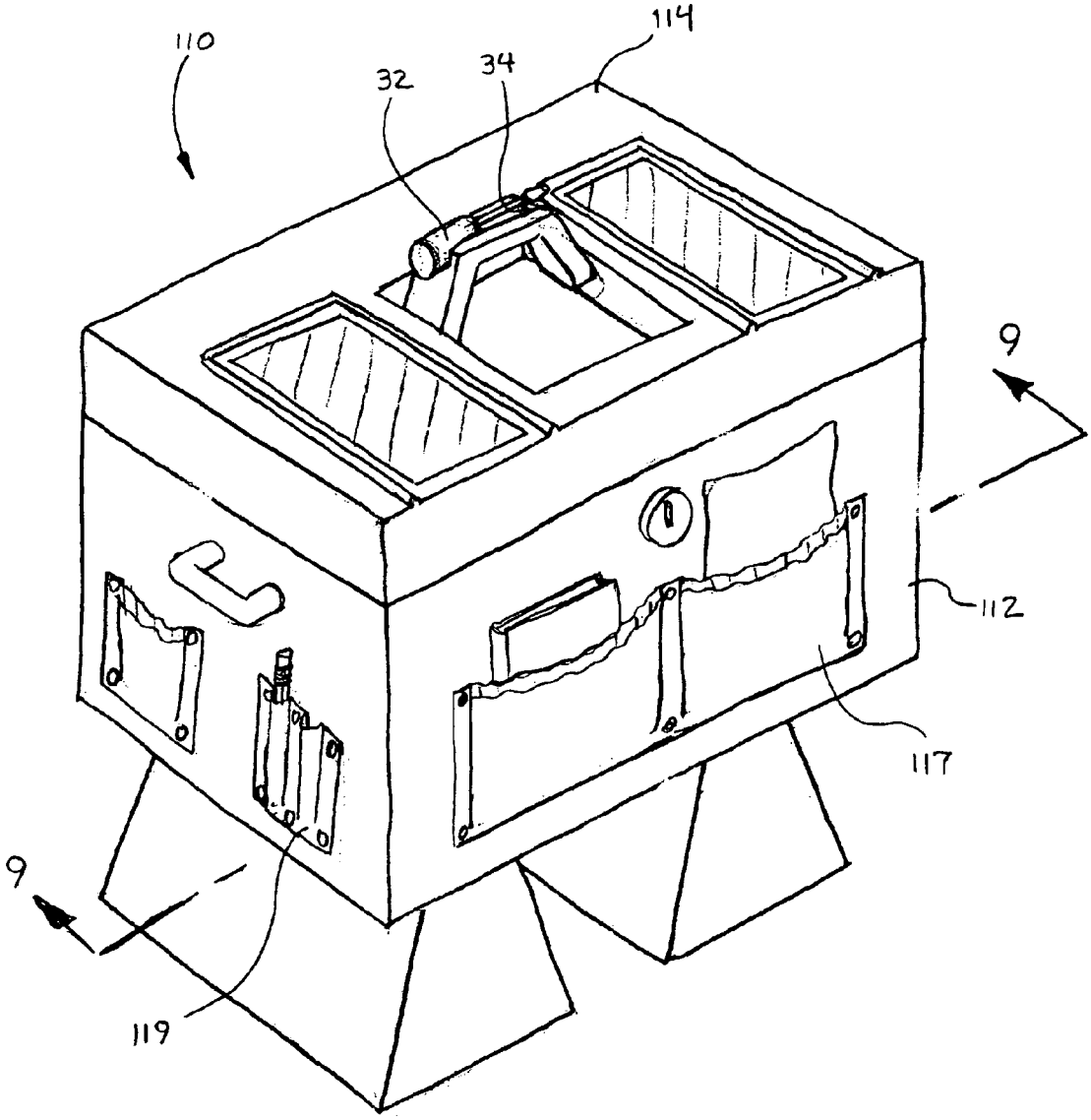
FIG. 8 is an schematic isometric view of a toolbox supported on wheel chocks according to another exemplary embodiment.
Figure 9:
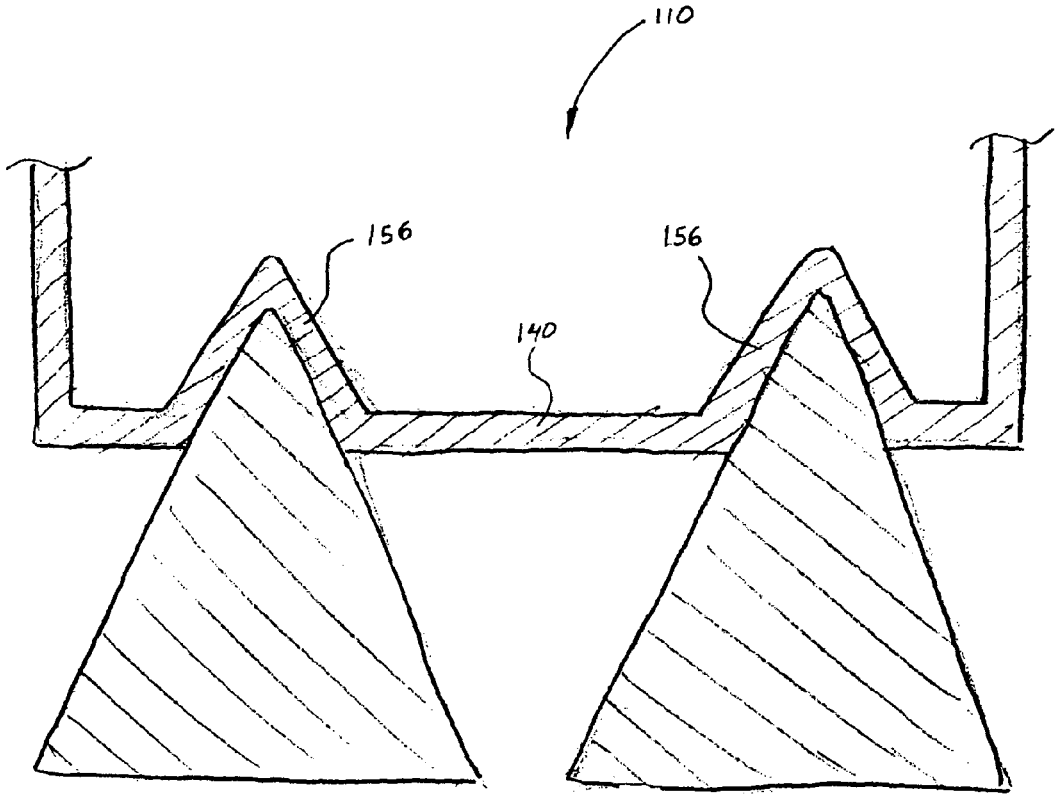
FIG. 9 is a partial cross-section of the toolbox in FIG. 8 taken along line 9-9.
Figure 10:
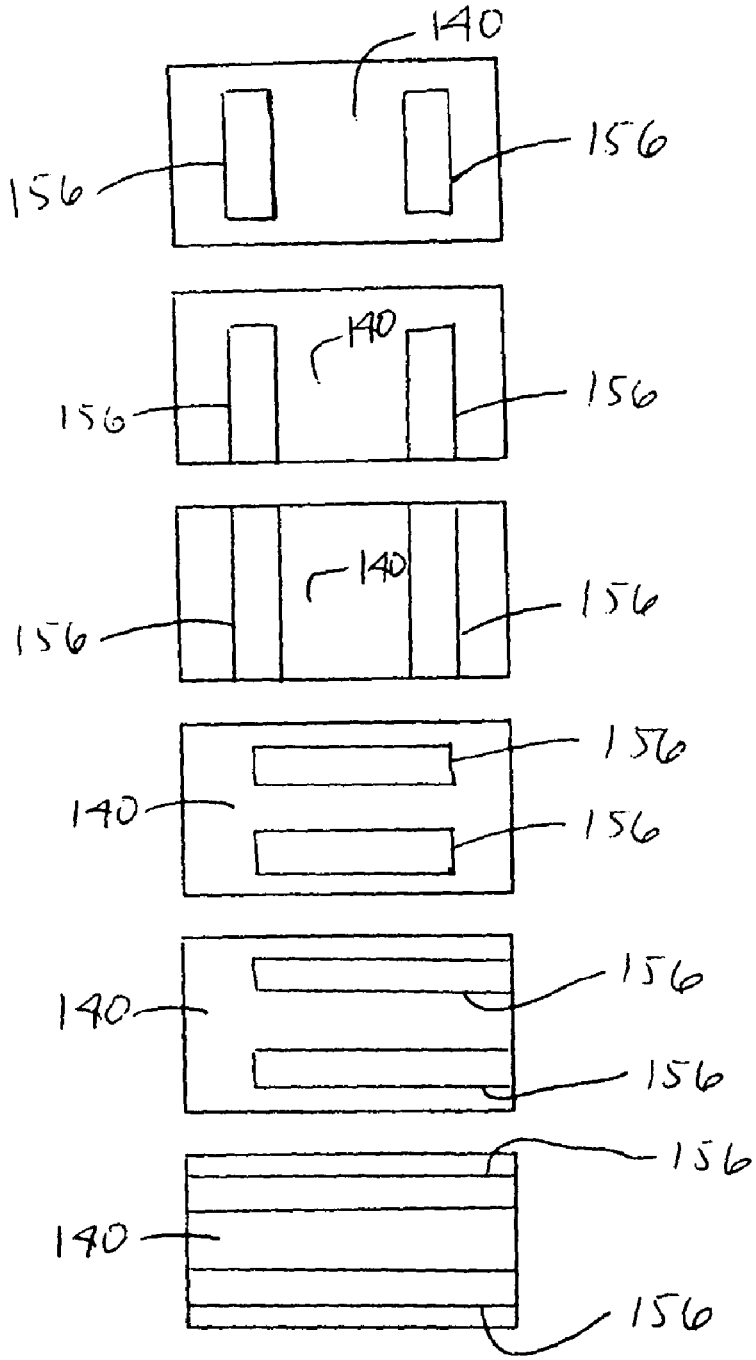
FIG. 10 is a series of bottom plan views of toolboxes with recesses that receive wheel chocks for elevating the toolbox according to a variety of exemplary embodiments and configurations.

Referring to FIGS. 8-9, a toolbox 110 is shown according to another exemplary embodiment. Toolbox 110 is generally similar to toolbox 10 and comprises a lid 114 (e.g., upper bin, top portion, cover, etc.), and a base 112 (e.g., lower bin, bottom portion, box, etc.). Base 112 has a bottom 140 that comprises at least two recesses 156. According to an exemplary embodiment, recesses 156 are shaped to receive an article or member that is not generally associate with a toolbox, but is likely to be located with or near toolbox so that additional support legs or other structures are not required to be included with toolbox. According to a preferred embodiment, recesses 156 are generally triangular or prismatic structures which may receive wheel chocks (braces, stops, blocks, etc.) in bottom 140 thereby allowing for toolbox 110 to be raised by an amount dependent upon the size of the wheel chocks that will be with the aircraft or at landing locations where the aircraft will be located and the toolbox (e.g., to inspect, repair, conduct maintenance, refuel, etc. aircraft). According to an exemplary embodiment, the recesses 156 have a depth of between about 1 inch and about 3 inches from an outer surface of the bottom wall 140. During use, the wheel chocks, or other structures, are placed on the ground where the elevated surface is needed. Toolbox 110 is then positioned on the chocks. The interface between the chocks and recesses 156 are intended to prevent tipping, tilting, or sliding of the toolbox 110 when the user stands on it. Recesses 156 may be open to one side of toolbox 110. FIG. 10 is a series of bottom plan views of a toolbox with recesses for elevating the toolbox according to a variety of exemplary embodiments and configurations.

Figure 11:
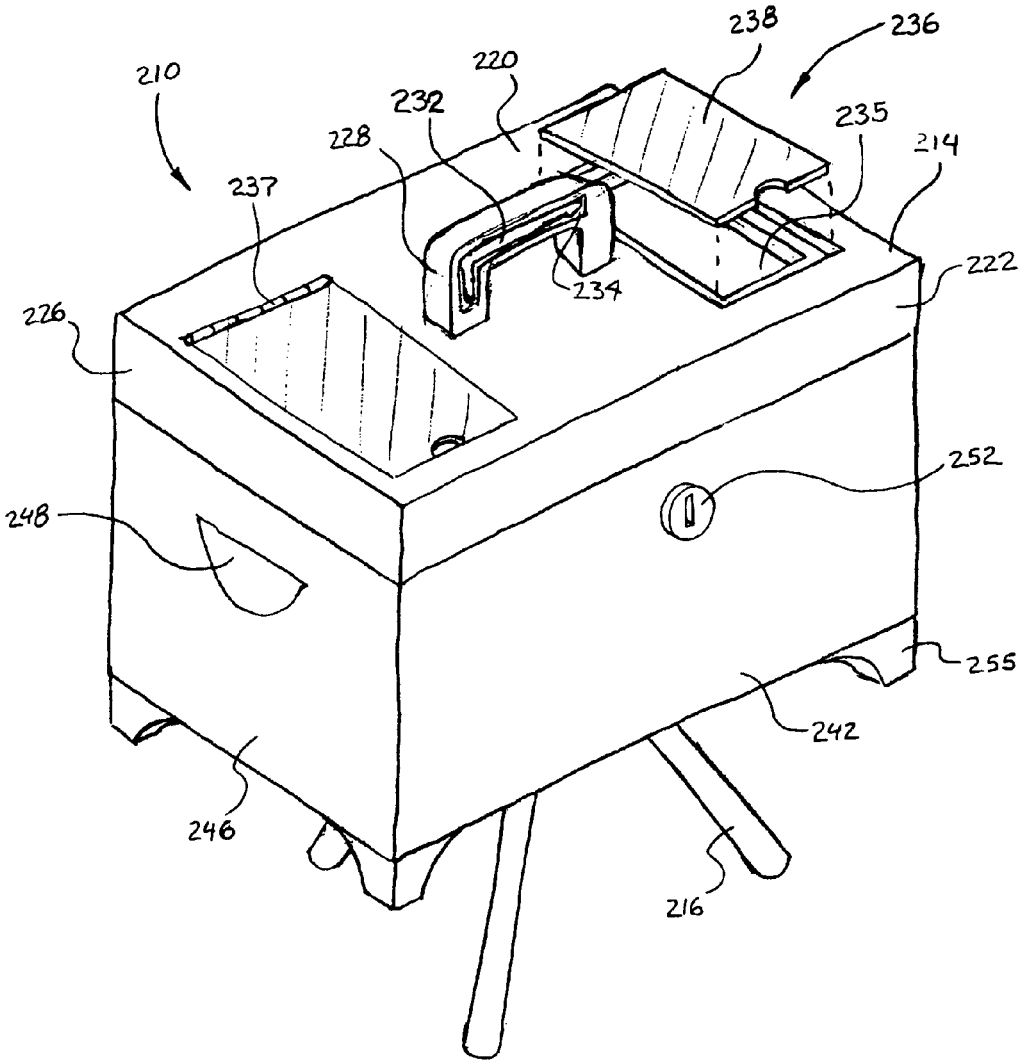
FIG. 11 is a schematic isometric view of a toolbox according to another exemplary embodiment.
Figure 12:
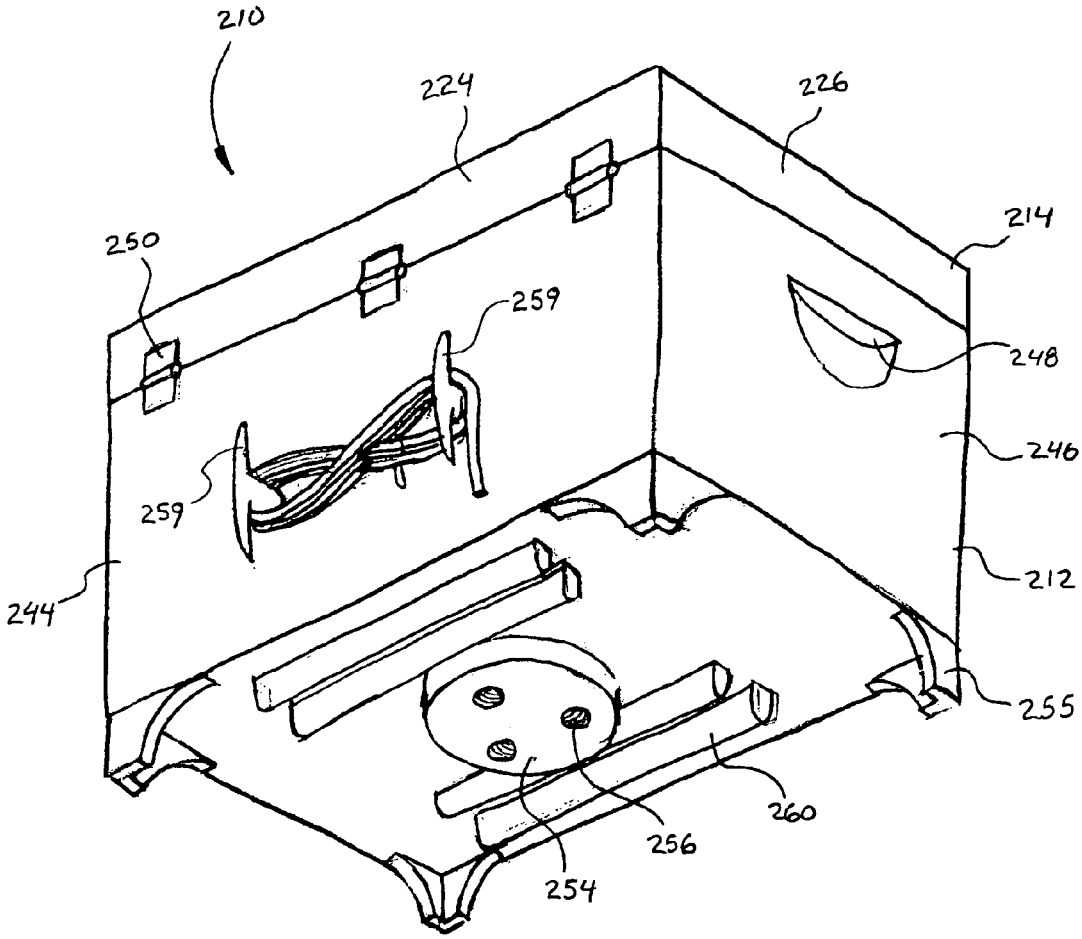
FIG. 12 is a schematic isometric view showing the bottom of the toolbox in FIG. 11.

Referring to FIGS. 11-12 a toolbox 210 is shown according to another exemplary embodiment. Toolbox 210 is a generally thin-walled box and comprises a lid 214 (e.g., upper bin, top portion, cover, etc.), a base 212 (e.g., lower bin, bottom portion, box, etc.), and legs 216 (e.g. support members, props, struts, etc.) that are configured to elevate toolbox 210. Toolbox 210 is configured to hold a flashlight, funnel, oil can and/or other objects or a combination of these. Toolbox 210 is further configured as a step for a user.

Lid 214 comprises a top 220, a front side wall 222 and rear side wall 224 that are generally parallel, two opposing end side walls 226 that are perpendicular to front side wall 222 and rear side wall 224, and a handle 228. According to an exemplary embodiment, side walls 222, 224, 226 extend downward from top 220 and are formed as a single unitary body with top 220. According to other exemplary embodiments, side walls 222, 224, 226 may be separate bodies and coupled to top 220 and each other with brackets or other suitable coupling members. Handle 228 coupled to lid 214 and is configured to allow a user to pick up toolbox 210. Lid 214 also includes storage compartments 235 covered by step areas 236. Step areas 236 are a removable cover to storage compartments 235 and fit into a stepped recess about the periphery of storage compartment 235. Alternatively, step area 236 is pivotably coupled to lid 214 by a hinge 237. Step area 236 include non-skid surface 238 (e.g., wing walk tape or other material).

Handle 228 comprises a contour 234 (shown as a recess, receptacle, groove, slot, etc.) for receiving and retaining tool 232 (e.g., snap-fit, interference fit, etc.). Contour 234 may have any of a variety of shapes to accept a variety of tools or other articles. The location of contour 234 may be on any of a variety of sides of the handle.

Base 212 comprises a bottom 240, a front side wall 242 and rear side wall 244 that are generally parallel, two opposing end side walls 246 that are perpendicular to front side wall 242 and rear side wall 244. According to an exemplary embodiment, side walls 242, 244, 246 extend upward from bottom 240 and are formed as a single unitary body with bottom 240. According to other exemplary embodiments, side walls 242, 244, 246 may be separate bodies and coupled to bottom 240 and each other with brackets or other suitable coupling members. End side walls 246 may comprise integrally formed side handles 248.

Lid 214 may be pivotably coupled to base 212 along one side with one or more hinges 250 and may be moveable between an open position and a closed position. Toolbox 210 comprises a locking mechanism 252 that is configured to substantially retain lid 214 in a closed position. According to other exemplary embodiments, toolbox 210 may include a latch or other latching or locking mechanisms known to those of skill in the art that prevent the lid 214 from freely pivoting from the base 212 on hinge 250. Base 212 also includes a pair of "T" shaped cleat or projection 259 extending from one of the sidewalls, such as rear side wall 244. Projections 259 are designed for storing tie-down ropes, cable, extension cord, or the like.

Referring now especially to FIG. 12, base further comprises a plurality of engaging structures 260, a plurality of protrusions 255, and a baseplate 254. Engaging structures 260 are analogous to engaging structures 60 in toolbox 10 such that engaging structures 260 may receive via pressure fit either aircraft tie downs 70, 72 or legs 216. Protrusions 255 (e.g., legs, stubs, etc.) are provided generally at the bottom corners of toolbox 210. Protrusions 255 extend downward from bottom 240 and raise toolbox 210 to provide clearance for baseplate 254 and allow toolbox to rest generally level on a level surface. According to an exemplary embodiment, base 212 includes one or more flexible storage pockets 117, 119 coupled to a side wall (e.g., front, side, rear, etc.). Pockets 117 are coupled along three sides and open along a fourth side (top) to provide access for receiving items such as maps, charts, pens, tools, manuals, or the like. Preferably, the open (fourth) side includes an elastic element to retain the pocket in a closed configuration. Pocket 119 is coupled along three sides between the sides to form sleeves that are open along a fourth side (top) to receive items such aspens, tools, or the like.

Baseplate 254 comprises at least three sockets 256 (e.g., holes, apertures, openings, etc.) for receiving at least three legs 216. Legs 216 are provided to raise the elevation of toolbox 210 such that a person may gain elevation by standing upon toolbox 210 when raised on legs 216. According to one exemplary embodiment, sockets 256 are threaded holes that are configured to allow legs 216 to be threadably coupled to base 212. According to other exemplary embodiments, legs 216 may be received by sockets 256 in another manner (e.g., a bayonet-style connection, a snap-fit connection, etc.) that suitably couples legs 216 to base 212.

Figure 16:
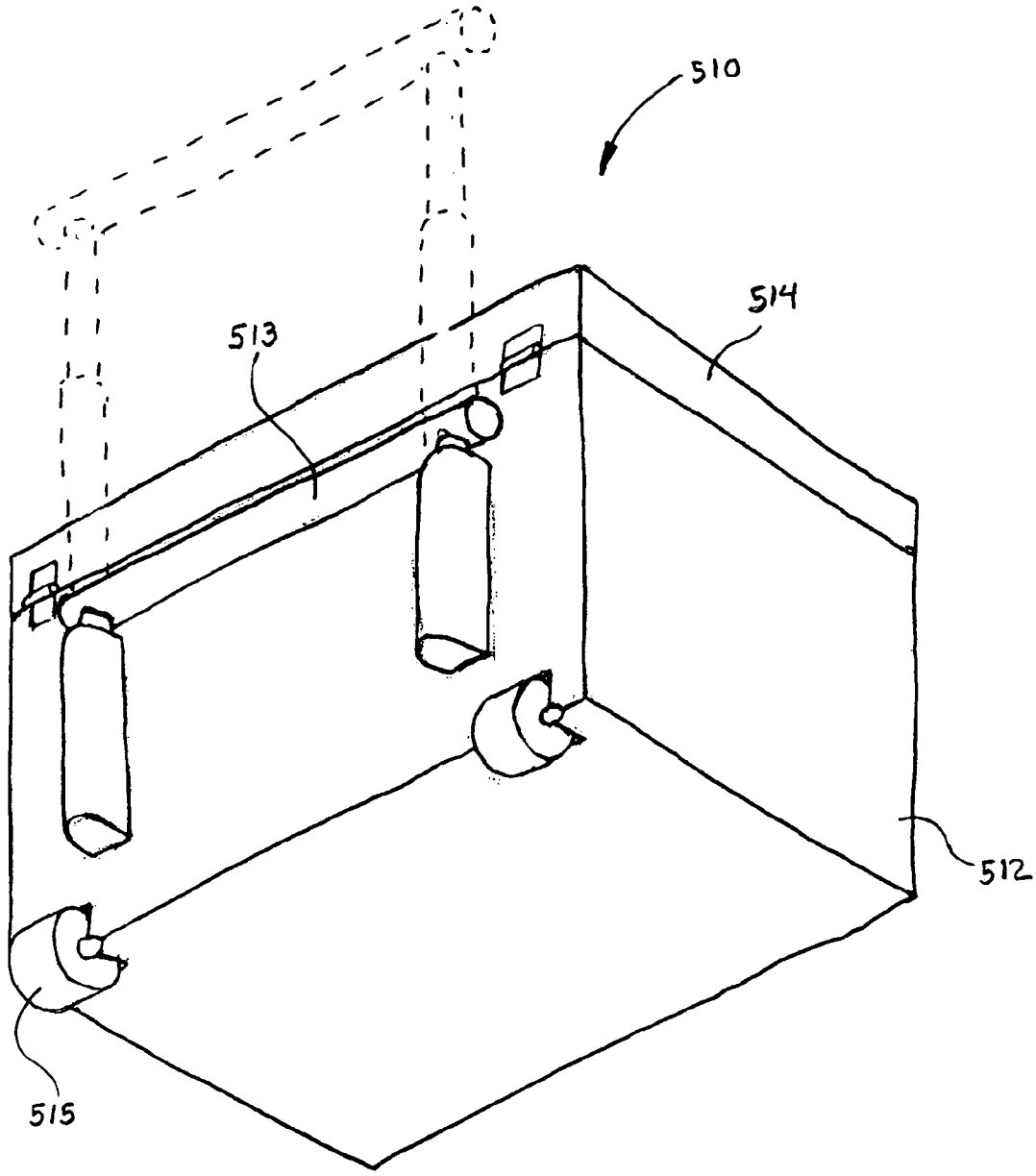
FIG. 16 is a schematic isometric view of a toolbox according to another exemplary embodiment with wheels and a retractable handle.

FIG. 16 is a schematic isometric view of a toolbox 510 according to another exemplary embodiment. Toolbox includes a base 512, a lid 514, and a transport assist assembly. The transport assist assembly includes a retractable/telescoping handle 513 and wheels 515 coupled to base 512. During use, the user lifts handle 513 to the desired height, tilts or pivots toolbox 510 so that it is supported on wheels 515 and pulls toolbox 510 along. According to alternative embodiments, the handle may be coupled to the lid, the handle and/or wheels may be located on a different side of the toolbox (on one of the sides, the front, etc.) according to the desired application and intended use.

It is important to note that the construction and arrangement of the toolbox as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements (e.g., end walls, etc.), the position of elements may be reversed or otherwise varied (e.g., engaging structures, retention areas, etc.), and the nature or number of discrete elements or positions may be altered or varied (e.g., more or fewer engaging structures could be used to provide holding areas for more legs or tie-downs). Accordingly, all such modifications are intended to be included within the scope of the present invention as defined in the appended claims. The order or sequence of any process or method steps may be varied or resequenced according to alternative embodiments. Other substitutions, modifications, changes and omissions may be made in the design, operating conditions and arrangement of the various exemplary embodiments without departing from the scope of the present inventions as expressed in the appended claims

What is claimed is:

1. A tool box combination comprising:

a first wheel chock;

a second wheel chock;

a tool box comprising:

a lower bin having a pair of opposed sidewalls, a front wall, a rear wall, and a bottom wall that define a storage space, the bottom wall comprising a first recess and a second recess, the first recess shaped to receive a portion of the first wheel chock and the second recess shaped to receive a portion of the second wheel chock;

a lid coupled to the lower bin by a hinge and movable between a closed position and an open position;

wherein the lower bin and lid are positionable at a first height when the bottom wall is in contact with a floor and the lower bin and lid are positionable at a second height when the first recess receives the first wheel chock and the second recess receives the second wheel chock.

2. The tool box combination of claim 1 wherein the first recess and the second recess each comprise a groove with a generally triangular-shaped cross-section.

3. The tool box combination of claim 1 wherein the first recess and the second recess each comprise a slot in the bottom wall of the lower bin and have a first portion and a second portion extending away from the first portion at an angle.

4. The tool box combination of claim 1 wherein the first recess and the second recess are located within the pair of side walls.

5. The tool box combination of claim 1 wherein the lid comprises a pair of spaced apart step areas to identify the location a person is to stand when stepping on the tool box.

6. The tool box combination of claim 5 wherein at least one of the step areas is a removable cover for a storage compartment.

7. The tool box combination of claim 6 wherein the removable cover is pivotally coupled to the lid by a hinge.

8. A method of using a toolbox, the method comprising:

providing a lower bin and a lid coupled to the lower bin by a hinge and movable between a closed position and an open position, the lower bin having a pair of opposed sidewalls, a front wall, a rear wall, and a bottom wall that define a storage space, the bottom wall comprising a first recess and a second recess;

providing a first wheel chock having a first portion and a second portion extending from the first portion at a first angle;

providing a second wheel chock having a first portion and a second portion extending from the first portion at a first angle;

arranging the first and second wheel chocks on the ground;

mounting the toolbox on the first and second wheel chocks by receiving portions of the wheel chocks in the first and second recesses in the bottom wall of the bin thereby providing lateral support;

stepping on the lid of the tool box.

9. The method of claim 8 wherein the objects are aircraft chocks.

10. A tool box kit, the tool box kit comprising:

a plurality of wheel chocks, each wheel chock comprising a first portion and a second portion extending from the first portion at a first angle;

a lower bin having a pair of opposed sidewalls, a front wall, a rear wall, and a bottom wall that define a storage space, the bottom wall comprising four recesses, each of the recesses shaped to receive a portion of one of the wheel chocks and having a first slot portion and a second slot portion extending away from first portion at a second angle;

a lid coupled to the lower bin by a hinge and movable between a closed position and an open position;

wherein the lower bin and lid are positionable at a first height when the bottom wall is in contact with a floor and is positionable at a second height when the four recesses each receive one of the wheel chocks.

11. The tool box kit of claim 10 wherein the first angle is ninety degrees.

12. The tool box kit of claim 11 wherein the second angle is ninety degrees.

* * * * *